United States Patent [19]

Eckman

[11] Patent Number: 4,631,012

[45] Date of Patent: Dec. 23, 1986

[54] PNEUMATIC TOOLS

[75] Inventor: Richard E. Eckman, Houston, Tex.

[73] Assignee: Dresser Industries, Inc., Dallas, Tex.

[21] Appl. No.: 778,953

[22] Filed: Nov. 25, 1985

Related U.S. Application Data

[63] Continuation of Ser. No. 426,516, Sep. 29, 1982, abandoned.

[51] Int. Cl.[4] ..... F03C 2/00

[52] U.S. Cl. ..... 418/70; 418/270

[58] Field of Search ..... 418/70, 270

[56] References Cited

U.S. PATENT DOCUMENTS

| | | | |
|---|---|---|---|
| 1,758,760 | 5/1930 | Price et al. | 418/270 X |
| 3,190,183 | 6/1965 | Walker et al. | 418/270 X |
| 3,901,631 | 8/1975 | Wickham et al. | 418/270 X |
| 4,197,061 | 4/1980 | Hill | 418/270 X |
| 4,268,233 | 5/1981 | Fernström | 418/270 X |

FOREIGN PATENT DOCUMENTS

| | | | |
|---|---|---|---|
| 871050 | 4/1942 | France | 418/270 |
| 7800572 | 7/1978 | Netherlands | 418/270 |
| 2093914 | 9/1982 | United Kingdom | 418/270 |

*Primary Examiner*—Carlton R. Croyle
*Assistant Examiner*—Theodore Olds
*Attorney, Agent, or Firm*—Richard M. Byron

[57] ABSTRACT

The tool housing-air motor assembly includes an air motor that is of modular design, that is, it is constructed so that the motor rotor is journaled in the cylinder by the end plates, which retain the motor in its operational alignment condition. The tool housing is used in the "as cast" condition without the necessity for performing any machining operations thereon. The assembly of the air motor and tool housing is possible since the motor is self-contained and does not rely on the tool housing for retaining the parts of the motor in assembled relationship or for retaining the motor parts in operational alignment.

1 Claim, 2 Drawing Figures

PNEUMATIC TOOLS

This is a continuation of application Ser. No. 426,516 filed Sept. 29, 1982, now abandoned.

BACKGROUND OF THE INVENTION

This invention relates generally to improved air tools. More particularly, but not by way of limitation, this invention relates to an improved air motor and to an improved air motor-tool housing assembly for air tools.

In the past, pneumatic power tools have included an air motor that is generally composed of a rotor journaled in a pair of end plates which are retained in spaced relation by a cylinder in which the rotor is located. These various components of the motor are retained in operational alignment by various shoulders and bores that have been formed in the tool housing. In accordance with this concept, the tool housings have been relatively expensive and the exchange of air motors in the event of an air motor failure, has been necessarily performed by a technician skilled in the repair of air tools. While this arrangement has proved reasonably satisfactory, it requires an inventory of an excess number of tools and, frequently, requires that the air tools be returned to the factory for service.

SUMMARY OF THE INVENTION

Accordingly, it is an object of this invention to provide an improved air motor and an improved air tool housing-air motor assembly wherein the air motor can be quickly and easily replaced thereby avoiding the necessity for highly qualified service personnel, or the necessity of returning the air tool to the factory for service. Therefore, the inventory necessary to maintain such air tools can be reduced, since it will be necessary to maintain only a few spare air motors for insertion into the air tools.

This invention provides, in one aspect, a modular pneumatic motor that comprises an elongated, hollow motor cylinder; a rotor located in the cylinder having a shaft portion; and motor ends journaling the rotor in the cylinder and engaging the cylinder for holding the cylinder, rotor and motor ends in operating relationship.

This invention provides in another aspect, an improved tool housing-pneumatic motor assembly for pneumatically powered tools wherein the assembly comprises an elongated, hollow motor cylinder; a motor rotor located in the cylinder that includes shaft portions; and first and second motor ends. The ends receive the shaft portion for journaling the rotor in the cylinder and for holding the cylinder, rotor and ends assembled in operating relationship. A hollow, cast tool housing is included for receiving the assembled motor cylinder, ends and rotor. The housing is used in the as cast condition. A tool housing end member is releasably connected to the housing and engages one of the motor ends to retain the assembled motor cylinder, ends and rotor in the housing.

BRIEF DESCRIPTION OF THE DRAWING

The foregoing and additional objects and advantages of the invention will become more apparent as the following detailed description is read in conjunction with the accompanying drawing wherein like reference characters denote like views and wherein.

DETAILED DESCRIPTION OF THE EMBODIEMNT OF FIG. 1

Figure 1:
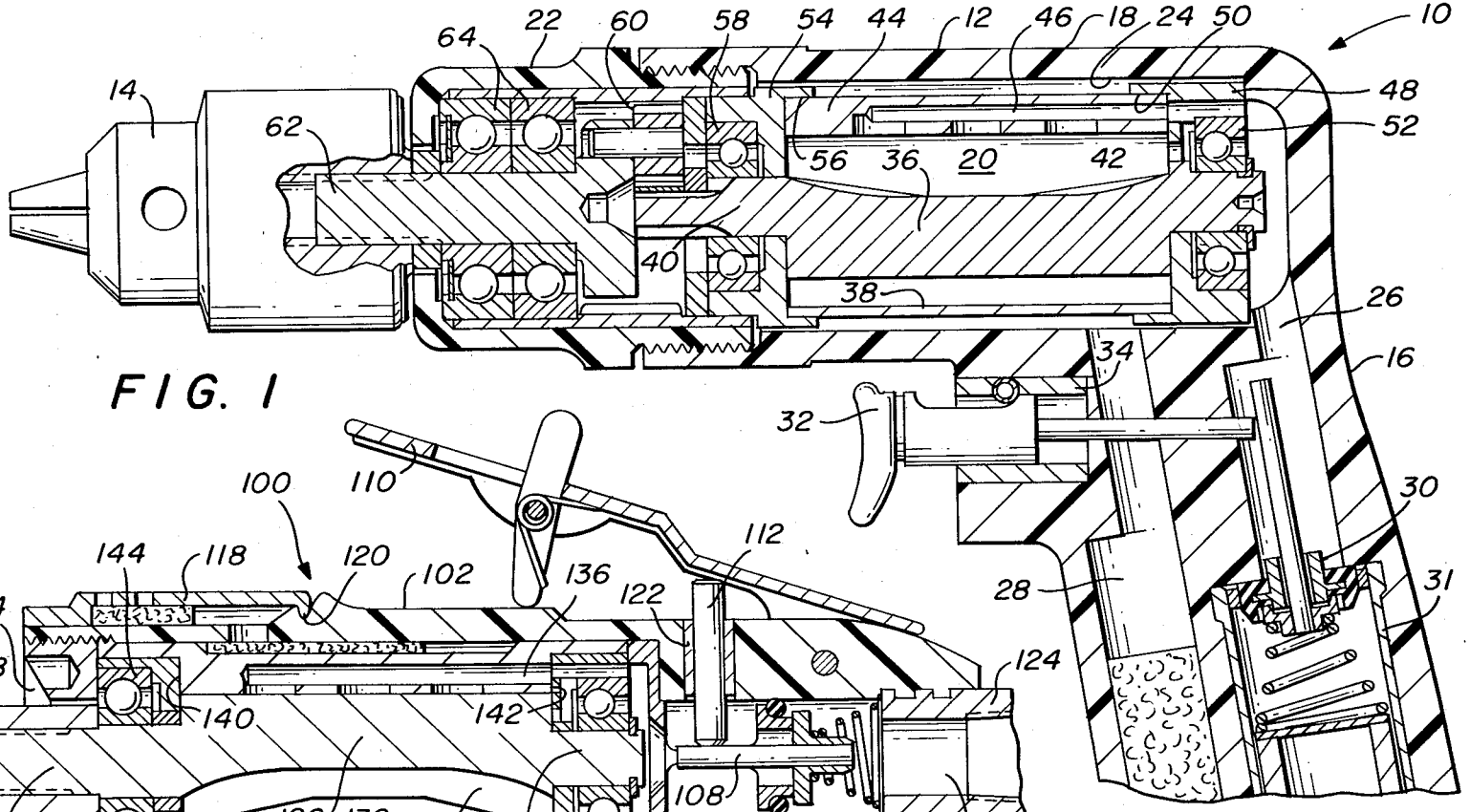
FIG. 1 is a cross-sectional view of a pneumatic drill that includes the modular motor and the tool housing-pneumatic motor assembly that is constructed in accordance with the invention.

Referring to the drawing, and to FIG. 1 in particular, shown therein and generally designated by the reference character 10, is a pneumatically powered drill that includes a housing 12 and a chuck 14. The housing 12 is hollow and includes a handle portion 16 which will be connected to a source of air under pressure and a body portion 18 that is hollow an as illustrated, receives an air motor that is generally designated by the reference character 20. The housing 12 also includes an end member 22 that is threadedly connected to the body portion 18.

As previously mentioned, the housing 12 is hollow, including an interior designated by the reference character 24, an inlet passageway 26 communicating with the interior 24, and an outlet passageway 28 also in fluid communication with the interior 24. The inlet passage 26 is provided with an inlet valve 30 that is actuated by a trigger 32 that is slidably positioned in a trigger bushing 34. The inlet valve 30 is mounted in a bushing 32 that is provided so that the drill 10 can be connected to the source of pressurized air (not shown).

It should also be pointed out that the housing 12 is constructed from a plastic that is preferably one of the high density synthetic resins, which may if desired, be reinforced with fiber glass.

The housing 12 is precision cast so that reasonable dimensional accuracy is maintained thereby eliminating the need for machining the casting. In fact, the interior 24, the inlet passageway 26, and outlet passageway 28 are utilized in the as cast condition. Bushings 32 and 34 are located in the mold prior to casting of the housing 12, and thus require no further machining.

Located in the interior 24 of the housing 12 is the air motor 20 which consists of a rotor 36 carrying one or more movable vanes or blades 38. The rotor 36 includes shaft portions 40 and 42 for journaling the rotor 36 in the air motor 20 as will be described. The rotor 36 is mounted in a hollow motor cylinder 44 that is provided with appropriate air passageways 46 for the operation of the motor 20.

Adjacent to the inlet passageway 26, the motor 20 is provided with an end member 48 that has a counterbore 50 located in one face thereof that is sized to closely receive the motor cylinder 44. The end member 48 is provided with a bearing 52 that rotatably supports the end of shaft portion 42 of the rotor 36.

Similarly, a second motor end member 54 is located in the housing 12 adjacent the opposite end of the motor cylinder 44. The end member 54 is provided with a counterbore 56 that is sized to receive the adjacent end of the motor cylinder 44. A bearing 58 is located in the end member 54 and rotatably supports the shaft portion 40 of the motor 20. Accordingly, the rotor 36, cylinder 44 and end members 48 and 54 are all retained in operational alignment due to the inter-engagement between the motor cylinder, end members and the shaft portions 40 and 42 of the rotor 36.

The tool housing end member 22 carries within its interior a planet and sun type gear reduction 60 that is operably connected with the shaft portion 40 of the motor 20. An output shaft 62 of the gear reduction 60 is supported for rotation in the housing end member 22 by ball bearings 64, as is evident, the chuck 14 is connected to the output shaft 62 for driving a drill bit or the like (not shown).

Upon assembly or repair of the pneumatic drill 10, the tool housing end member 22 is separated from the housing 18. The motor 20, assembled as previously described, is placed in the interior 24 of the housing 12 with the shaft portion 40 being oriented toward the open end of the housing portion 18. The tool housing end member 22 with its previously mounted gear reduction 60, bearing 64 and output shaft 62, is screwed into the housing portion 18 completing the assembly. From the foregoing, it can be seen that the air motor 20 can be quickly and easily placed in or removed for repair from the drill 10. It is not necessary to provide any shims, bushings or alignment features within the motor 20 due to the modular structure of the air motor 20.

In operation, the pneumatic drill 10 functions as any other drill, that is, the trigger 32 is depressed opening the inlet valve 30 and admitting air through the inlet passageway 26 to the air motor 20. The pressurized air, upon reaching the air motor 20, causes the rotor 36 to rotate driving the gear reduction 60, the output shaft 62 and connected chuck 14 to rotate the drill bit. Air exhausted from the motor 20 passes through the outlet passageway 28 and is discharged through appropriate silencers, filters, etc. to the atmosphere.

DESCRIPTION OF THE EMBODIMENT OF FIG. 2

Figure 2:
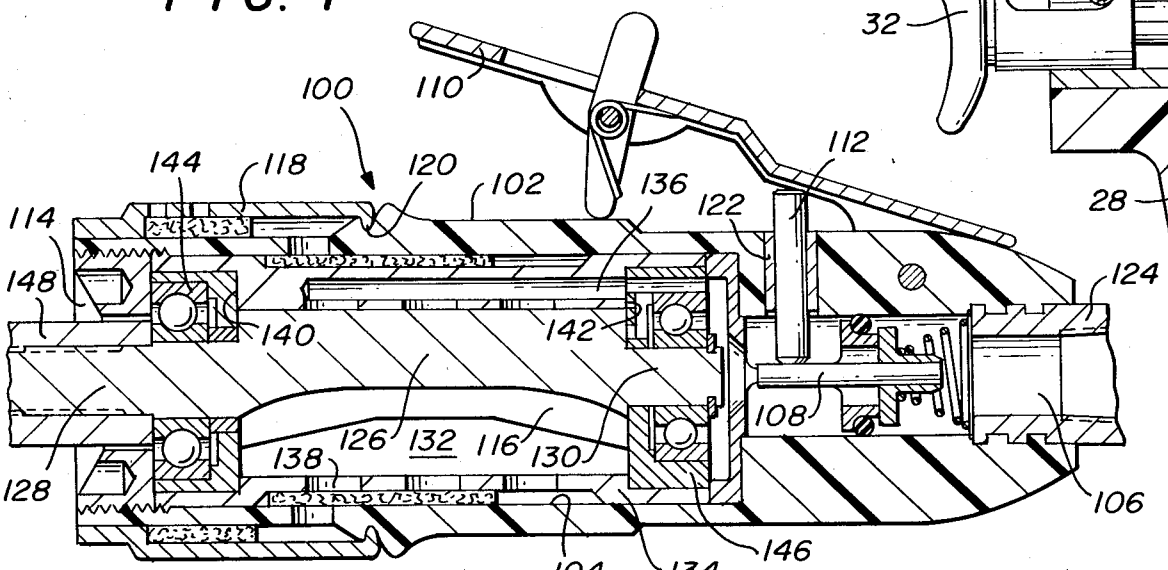
FIG. 2 is a cross-sectional view of another pneumatic tool that includes another embodiment of modular motor and tool housing-motor assembly that is also constructed in accordance with the invention.

FIG. 2 illustrates a pneumatic grinder 100 that is constructed by the same methods utilized in the manufacture of the pneumatic drill 10. The grinder 100 includes a housing 102 that is, like the housing 12, constructed preferably by casting from one of the high density synthetic resins. If desired, the resin can be reinforced with a fiber glass or other suitable material.

The housing 102 includes a hollow interior 104 and inlet passageway 106 that is connected with the interior 104 through an inlet valve 108. The inlet valve 108 is actuated by a trigger 110 through a plunger 112.

A tool housing end member 114 is threadedly connected to the housing 102 to retain air motor 116 therein. An adjustable, plastic exhaust cover 118 is snapped into a groove 120 formed in exterior of the housing 102. The cover 118 is rotatable so that the exhaust can be conventionally directed as desired.

In order to use the housing 102 in the as cast condition, that is, without any machining thereon, trigger bushing 122 is cast into the housing. Similarly, inlet bushing 124 is also cast into the housing 102 when it is formed. The inlet bushing 124 is arranged to be connected with a source of air under pressure (not shown) to operate the air motor 116.

The air motor 116 includes a rotor 126 having shaft portions 128 and 130. The rotor 126 carries a plurality of slidable vanes 132. The rotor 126 is rotatably located within an air motor cylinder 134, which is provided with inlet and exhaust passageways 136 and 138, respectively.

The cylinder 136 is provided with counterbores 140 and 142 at each end thereof for receiving air motor end members 144 and 146, respectively. The end members 144 and 146 each carry a bearing for rotatably supporting the shaft portions 128 and 130. The shaft portion 128 serves as the output shaft and is connected to the desired form of chuck 148, which will of course, be arranged to receive appropriate grinder tool (not shown).

In operation, the trigger 110 is depressed, actuating the valve 108 to admit air from the air passageway 106 into the inlet passageway 136 of the air motor 116. Air entering the motor 116 causes the rotor 126 to rotate driving the output shaft portion 128 and the chuck 148. Air exiting from the air motor 116 passes through the outlet passageways 138 and subsequently through the exhaust passageways into the atmosphere.

From the foregoing detailed description, it will be apparent that both embodiments of air tool described herein provide a means of using a tool housing in an as cast condition. In each embodiment, the air motors 20 and 116 are modular in configuration, and each is arranged so that the components thereof are retained in operational alignment by the inter action of the various parts. Thus, it is not necessary to provide precise supporting diameter shoulders, etc. within the air tool housing, and thus, the tool housings can be utilized in their as cast condition.

Further, it should be apparent that each of these tools can be readily assembled and maintained by relatively unskilled personnel by simply inserting the modular air motors therein and placing the housing end members thereon to retain the motor in the housing. Substantial reductions in inventory can be accomplished, since it is not necessary to stock an entire air tool, but only to maintain a small supply of extra motors on hand to replace the motors in the event of motor failure in the air tool. Obviously, the motors can be quick and easily replaced by unskilled personnel to place the air tools back in operating condition. This feature eliminates the necessity for returning an entire tool to the factory and eliminates the necessity of having highly skilled technicians to repair the tools.

The foregoing examples are presented by way of example only, and it will be understood that many changes and modifications can be made therein without departing from the spirit and scope of the invention.

The embodiments of the invention in which an exclusive property or privilege is claimed are defined as follows:

1. In a pneumatic powered tool, with an improved tool housing and pneumatic motor assembly, comprising:

(a) an elongated motor assembly with a hollow motor cylinder, a motor rotor located in said cylinder and including a shaft portion extending from each end thereof, first and second motor end means receiving shaft portion for journaling said rotor in said motor cylinder and engaging said motor cylinder for holding said motor cylinder, said motor rotor, and said motor end means assembled in an operating relationship;

(b) a hollow cast pneumatic powered tool housing body constructed from a high density plastic material and being hollow for receiving and mounting in a motor end portion thereof as an assembly said motor cylinder, both of said motor end means and said motor rotor, said housing body motor end portion having a hollow interior with an open end portion, a generally cylindrical internal side wall, a closed end portion, and a planer abutment at said closed end portion oriented transverse to said generally cylindrical internal side wall, said generally cylindrical internal side wall being sufficiently larger than the exterior of said motor cylinder and said motor end means so as not to contact said motor cylinder exterior and said motor end means and not provide structural support for said motor cylinder around the cylindrical exterior thereof; and said first motor end means for supporting and positioning said rotor being positioned in abutting and supporting contact with said planer abutment only and said tool housing body having a handle end portion including an air valve means operably mounted therein to control air flow between an air source inlet in said handle portion and said motor assembly through a passageway communicating with said housing closed end portion;

(c) a tool housing end member threadedly mounted to said housing body and mechanically engaged with said motor second end means at said housing body open end portion to compressively clamp and physically retain said motor assembly in an operating position wherein said first motor end means is positioned in abutting and supporting contact with said planer abutment and supporting contact with said planer abutment in said tool housing and also mounted in air flow sealing contact with said planer abutment in order to insure air flow through said tool housing closed end portion from said air valve means to said motor assembly;

(d) said first and second motor end means each receive one of said shaft portions for journaling said motor rotor in said motor cylinder and for holding said motor cylinder, said motor rotor and both of said motor end means in an operating relationshp;

(e) each of said motor end means includes a counterbore in facing sides thereof for receiving and mounting therein each one an end portion of said motor cylinder and said motor rotor in an operating relationship; and (f) one of said motor shaft portions being an output shaft being a sun gear of a planetary gear assembly having gear teeth formed thereon to be operably engageable with a planetary gear assembly upon installation of said motor assembly in said tool housing body to provide an output drive for mounting a drive bit chuck.

* * * * *